US006470518B1

(12) United States Patent
Ke

(10) Patent No.: US 6,470,518 B1
(45) Date of Patent: Oct. 29, 2002

(54) HAMMOCK ASSEMBLY

(76) Inventor: Shiu-Feng Ke, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/854,969

(22) Filed: May 11, 2001

(51) Int. Cl.[7] ..... A45F 3/22
(52) U.S. Cl. ..... 5/120; 5/127; 5/130
(58) Field of Search ..... 5/120, 122, 127, 5/128, 130, 98.3; 472/118, 125; 297/184.1, 184.15, 273

(56) References Cited

U.S. PATENT DOCUMENTS 1,346,973 A * 7/1920 Padden ..... 297/280
2,251,299 A * 8/1941 Spangler ..... 135/96
2,618,788 A * 11/1952 Cole et al. ..... 5/128

* cited by examiner

*Primary Examiner*—Heather Shackelford
*Assistant Examiner*—Fredrick Conley

(57) ABSTRACT

A hammock assembly has a bed net, a pair of support frames to support the bed net, and a connection tube set. The connection tube set has a first tube and a second tube engaging with the first tube. The first tube has a distal protrusion. The second tube has a through hole to receive the distal protrusion of the first tube. Each support frame has a joint and three support rods. The joint has a transverse round hole to receive the connection tube set, three lower circular holes to receive the support rods, a first threaded hole communicating with the transverse round hole, and three second threaded holes each communicating with the corresponding lower circular holes.

4 Claims, 6 Drawing Sheets

HAMMOCK ASSEMBLY

BACKGROUND OF THE INVENTION

The present invention relates to a hammock assembly. More particularly, the present invention relates to a hammock assembly which has two support frames.

A conventional hammock is often suspended on trees. However, the trees will be damaged after a long period of usage.

SUMMARY OF THE INVENTION

An object of the present invention is to provide a hammock assembly which has two support frames to support a bed net.

Another object of the present invention is to provide a hammock assembly which is assembled easily.

Accordingly, a hammock assembly comprises a bed net, a pair of support frames to support the bed net, and a connection tube set. The connection tube set has a first tube and a second tube engaging with the first tube. The first tube has a distal-protrusion. The second tube has a through hole to receive the distal protrusion of the first tube. The support frames each has a joint and three support rods. The joint has a transverse round hole to receive the connection tube set, three lower circular holes to receive the support rods, a first threaded hole communicating with the transverse round hole, and three second threaded holes each communicating with the corresponding lower circular holes.

DETAILED DESCRIPTION OF THE INVENTION

Figure 1:
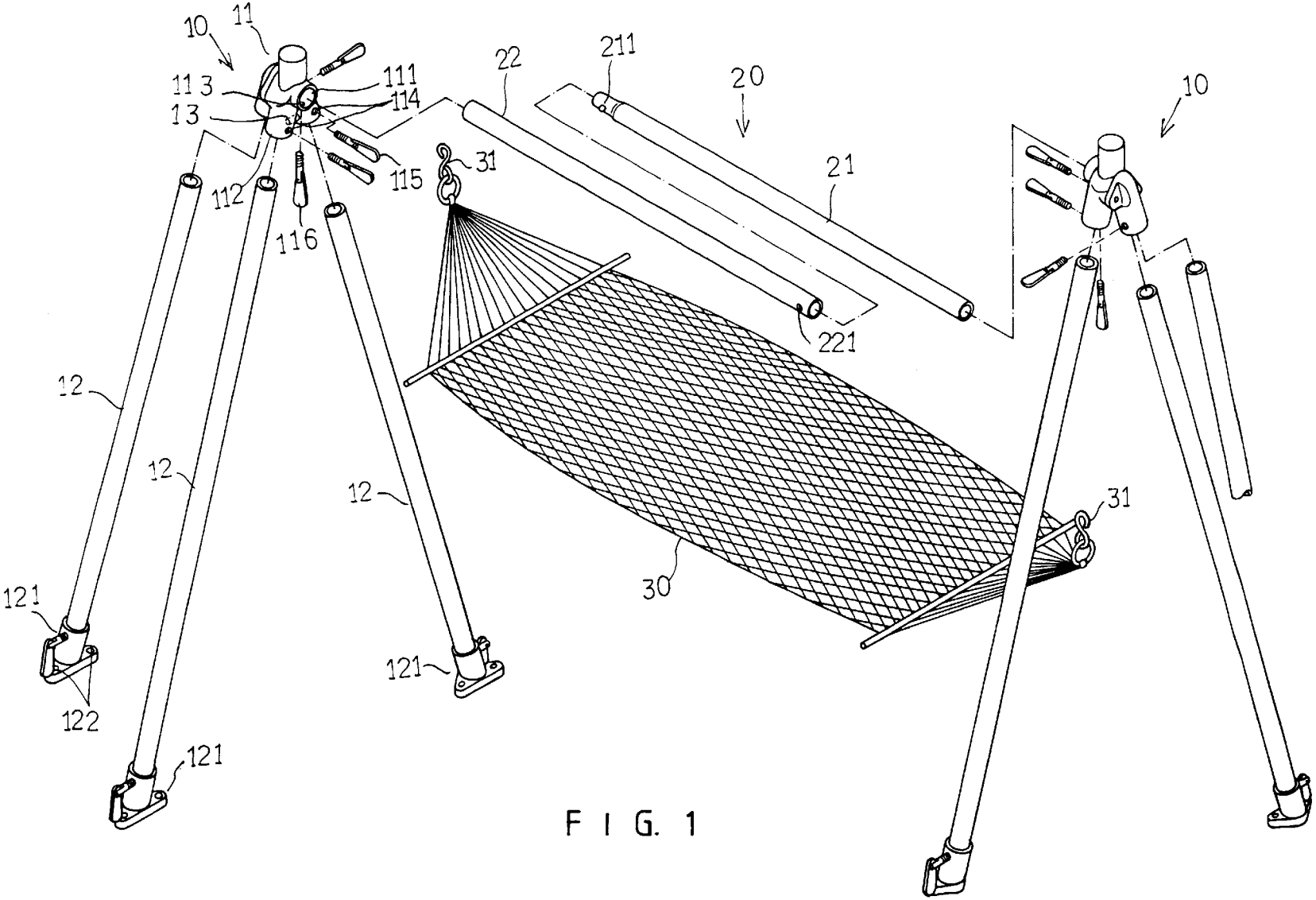
FIG. 1 is a perspective exploded view of a hammock assembly of a first preferred embodiment in accordance with the present invention.
Figure 2:
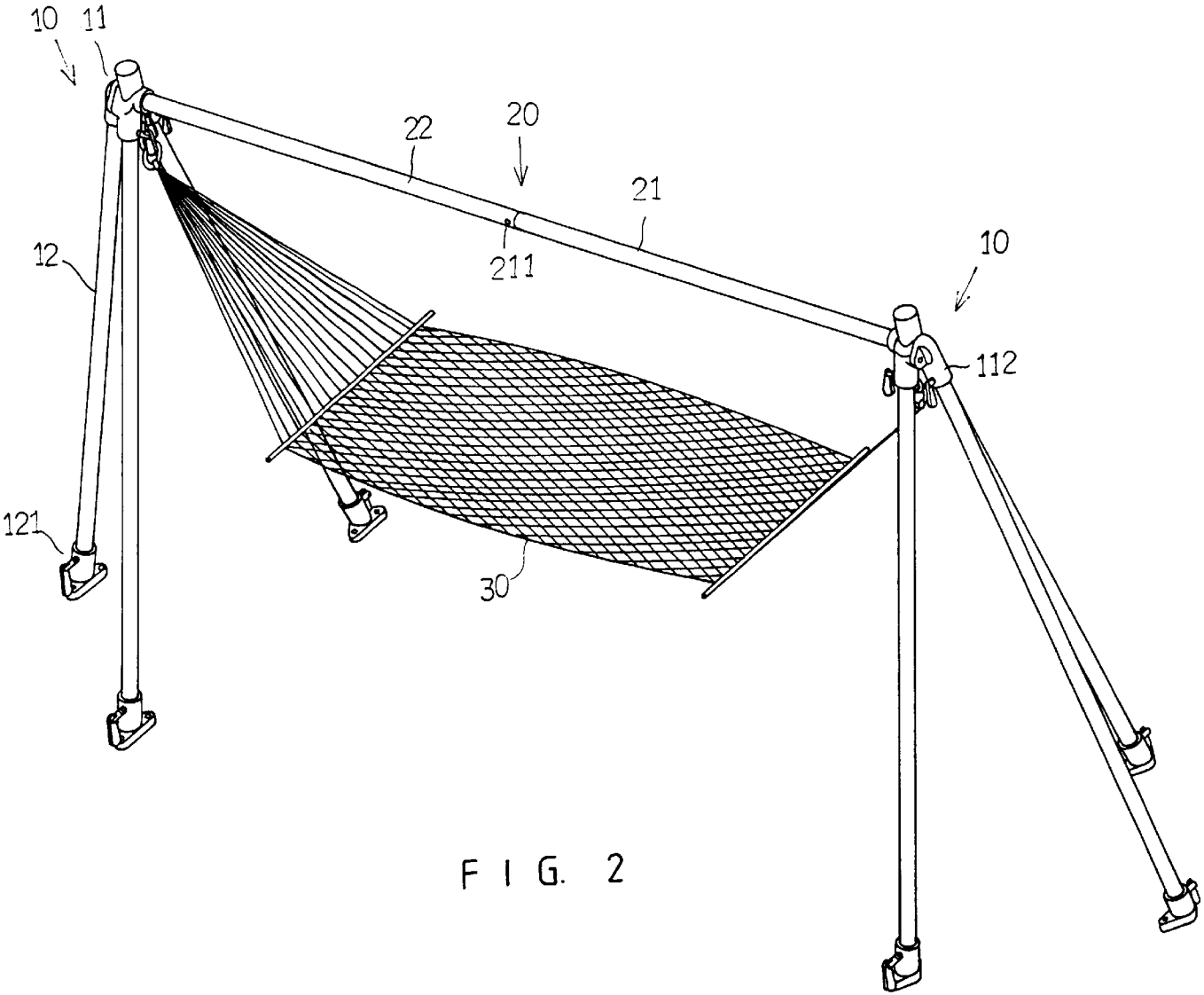
FIG. 2 is a perspective assembly view of a hammock assembly of a first preferred embodiment in accordance with the present invention.
Figure 3:
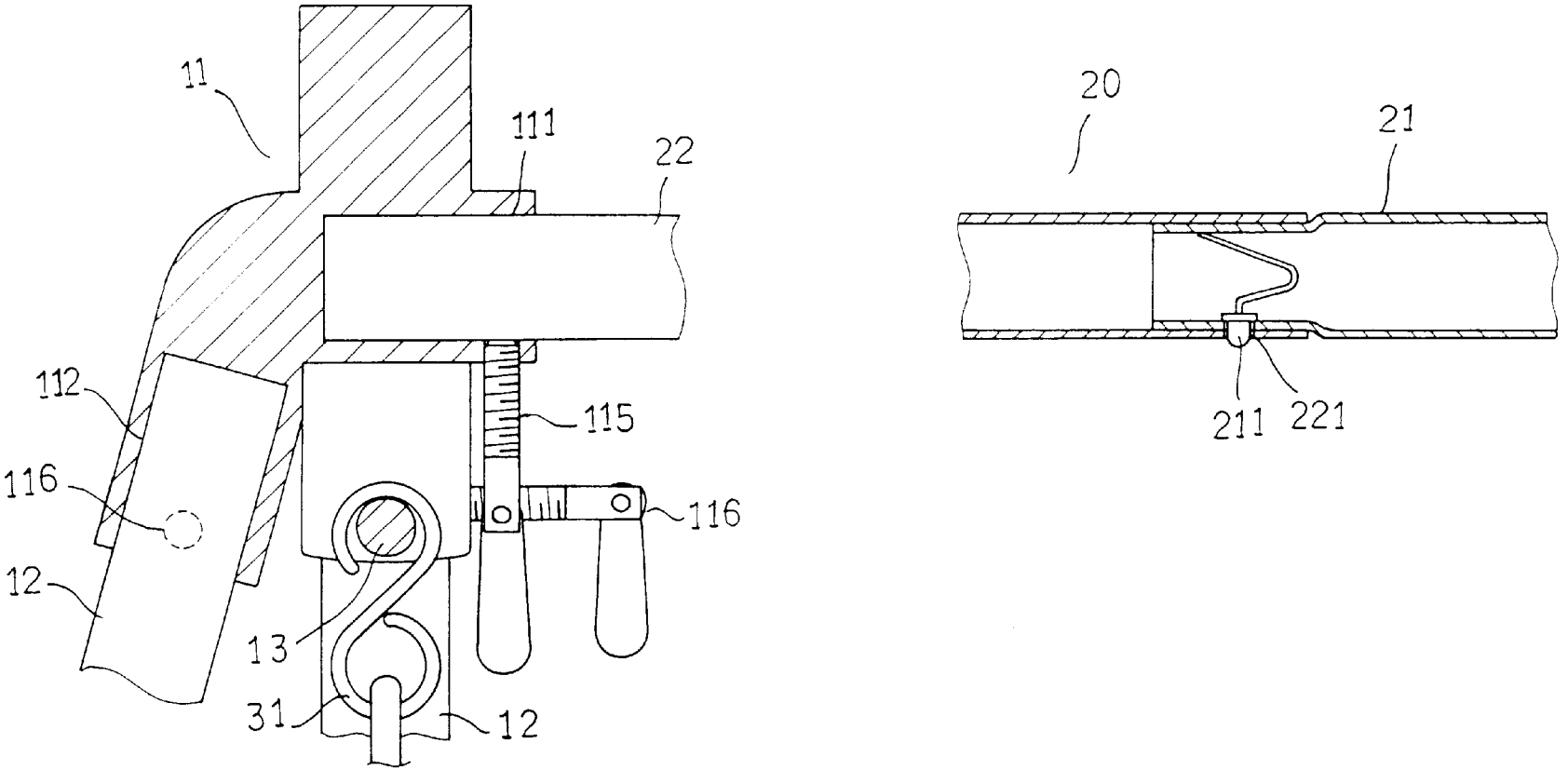
FIG. 3 is a partially sectional assembly view of a hammock assembly of a first preferred embodiment in accordance with the present invention.
Figure 4:
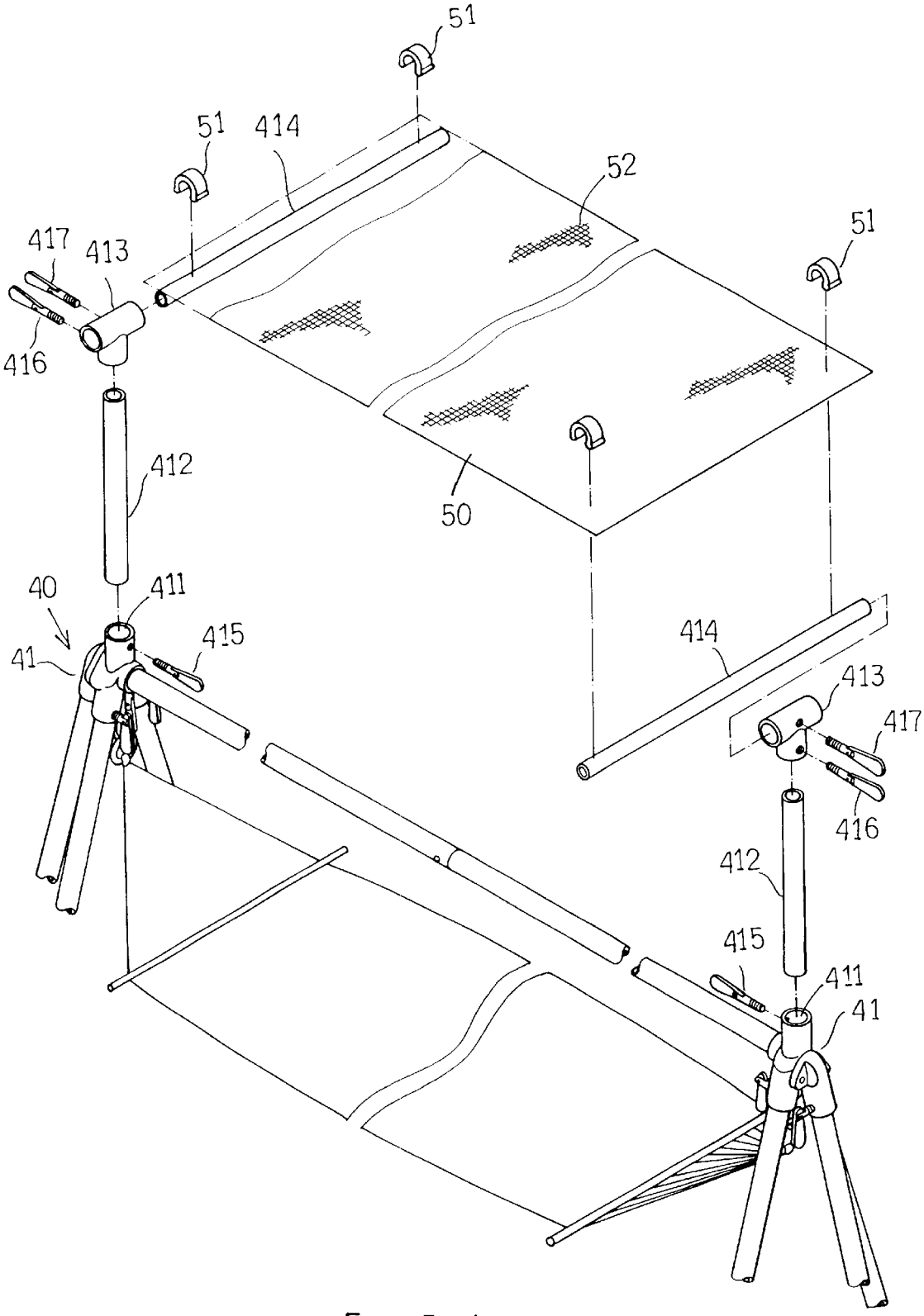
FIG. 4 is a perspective exploded view of a hammock assembly of a second preferred embodiment in accordance with the present invention.
Figure 5:
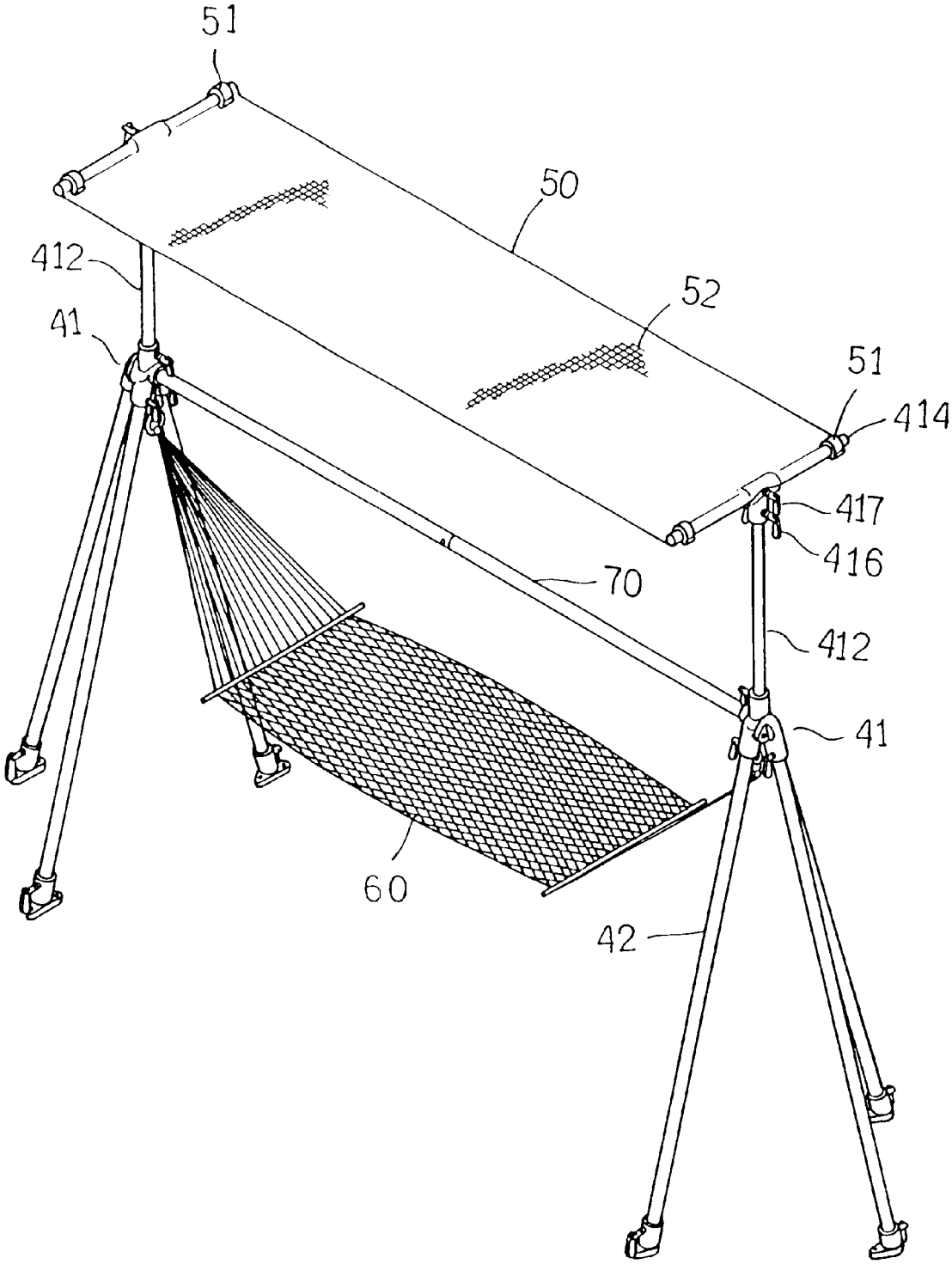
FIG. 5 is a perspective assembly view of a hammock assembly of a second preferred embodiment in accordance with the present invention.
Figure 6:
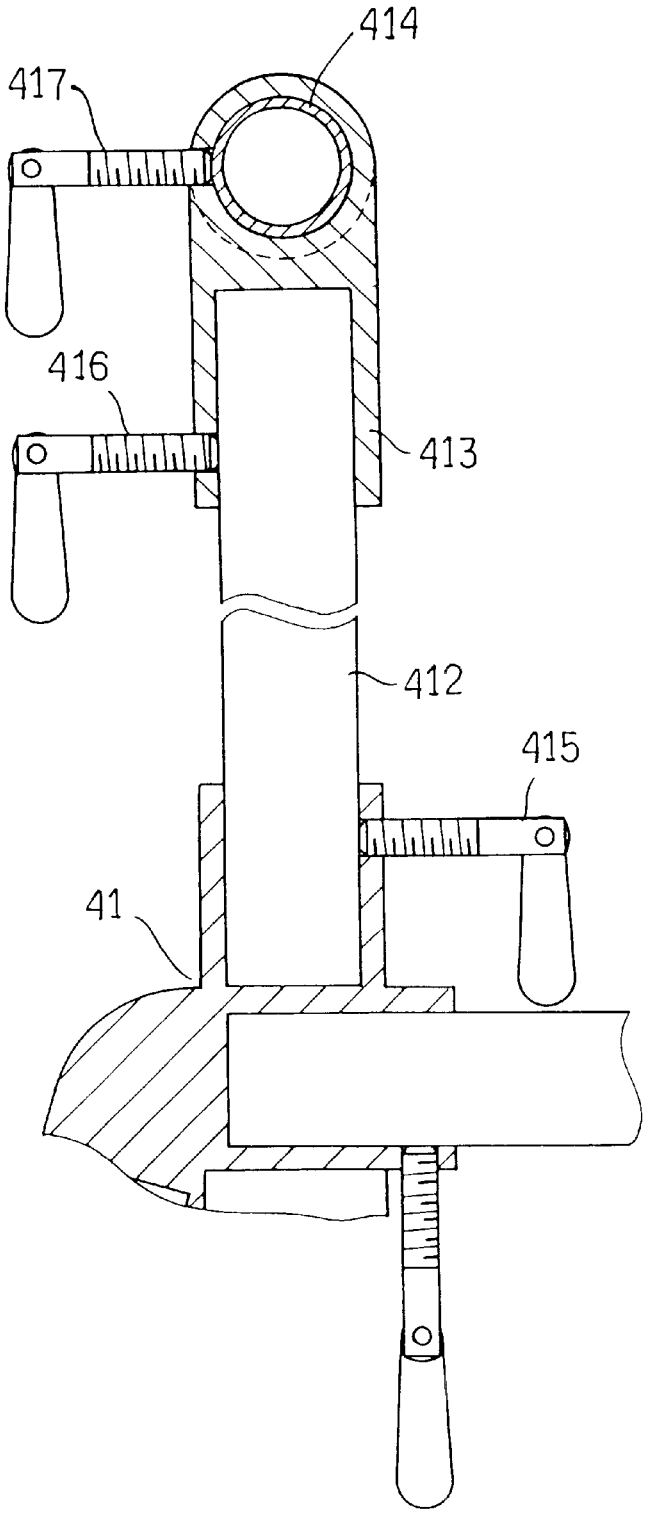
FIG. 6 is a partially sectional assembly view of a hammock assembly of a second preferred embodiment in accordance with the present invention.
Figure 7:
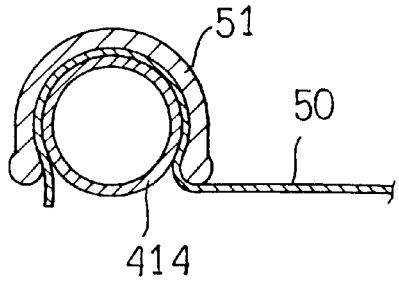
FIG. 7 is another partially sectional assembly view of a hammock assembly of a second preferred embodiment in accordance with the present invention.

Referring to FIGS. 1 to 3, a first hammock assembly comprises a bed net 30, a pair of support frames 10 to support the bed net 30, and a connection tube set 20.

The connection tube set 20 has a first tube 21 and a second tube 22 engaging with the first tube 21.

The first tube 21 has a distal protrusion 211.

The second tube 22 has a through hole 221 to receive the distal protrusion 211 of the first tube 21.

The support frames 10 each has a joint 11 and three support rods 12.

The joint 11 has a transverse round hole 111 to receive the connection tube set 20, three lower circular holes 112 to receive the support rods 12, a first threaded hole 113 communicating with the transverse round hole 111, and three second threaded holes 114 each communicating with the corresponding lower circular holes 112.

Three pedestal seats 121 each receives a lower end of the corresponding support rod 12.

Each of the pedestal seats 121 has a plurality of through apertures 122.

Two crossbars 13 each is disposed on a lower portion of the corresponding joint 11.

The bed net 30 has two distal hooks 31 hooks on the crossbars 13.

A first screw 116 passes through the first threaded hole 113 of the corresponding joint 11.

Three second screws 115 each passes through the corresponding second threaded hole 114 of the corresponding joint 11.

Referring to FIGS. 4 to 7, a second hammock assembly comprises a bed net 60, a pair of support frames 40 to support the bed net 60, a pair of longitudinal pipes 412, a pair of T-shaped connectors 413, a pair of transverse pipes 414, two pairs of clamp devices 51, and a connection tube set 70.

Each of the T-shaped connectors 413 is disposed on the corresponding longitudinal pipe 412.

Each of the transverse pipes 414 passes through the corresponding T-shaped connector 413.

The support frames 10 each has a four-way joint 41 ,connected to the connection tube set 70, and three support rods 42 connected to the four-way joint 41.

The four-way joint 41 comprises an upper longitudinal hole 411 to receive the corresponding longitudinal pipe 412.

A top fabric 50 and the transverse pipes 414 are clamped by the clamp devices 51.

A first bolt 415 fastens the four-way joint 41 and the corresponding longitudinal pipe 412 together.

A second bolt 415 fastens the T-shaped connector 413 and the corresponding longitudinal pipe 412 together.

A third bolt 415 fastens the T-shaped connector 413 and the corresponding transverse pipe 414 together.

The invention is not limited to the above embodiment but various modification thereof may be made. Further, various changes in form and detail may be made without departing from the scope of the invention.

I claim:

1. A hammock assembly comprises:

a bed net, a pair of support frames to support the bed net, and a connection tube set, the connection tube set having a first tube and a second tube engaging with the first tube, the first tube having a distal protrusion, the second tube having a through hole to receive the distal protrusion of the first tube, the support frames each having a joint and three support rods, and the joint having a transverse round hole to receive the connection tube set, three lower circular holes to receive the support rods, a first threaded hole communicating with the transverse round hole, and three second threaded holes each communicating with the corresponding lower circular holes.

2. The hammock assembly as claimed in claim 1, wherein three pedestal seats each receives a lower end of the corresponding support rod.

3. The hammock assembly as claimed in claim 1, wherein the joint further has an upper longitudinal hole, a longitudinal pipe is inserted in the upper longitudinal hole of the joint, a T-shaped connector is disposed on the longitudinal pipe, a transverse pipe passes through the T-shaped connector, and a top fabric and the transverse pipe are clamped by a plurality of clamp devices.

4. The hammock assembly as claimed in claim 1, wherein two crossbars each is disposed on a lower portion of the corresponding joint, and the bed net has two distal hooks hooks on the crossbars.

* * * * *